United States Patent [19]

Deitz

[11] Patent Number: 4,964,745

[45] Date of Patent: Oct. 23, 1990

[54] CONTAINER FOR STORING AND DISPENSING SEMI-SOFT STICKLIKE FOOD PRODUCTS

[76] Inventor: Rosemary Deitz, 522 - 4th Ave., Sydney, Ohio 45385

[21] Appl. No.: 389,262

[22] Filed: Aug. 3, 1989

[51] Int. Cl.[5] ..... A47G 19/18; A47G 19/26

[52] U.S. Cl. ..... 401/131; 401/12; 401/176

[58] Field of Search ..... 401/12, 176, 179, 182, 401/82, 131

[56] References Cited

U.S. PATENT DOCUMENTS 721,168 2/1903 Egert ..... 401/176 X 1,213,655 1/1917 Keil ..... 401/179

2,458,120 1/1949 Volpini ..... 401/12

2,893,032 7/1959 Selmer ..... 401/12

FOREIGN PATENT DOCUMENTS 574649 4/1933 Fed. Rep. of Germany ..... 401/176

*Primary Examiner*—Steven A. Bratlie

*Attorney, Agent, or Firm*—T. M. Gernstein

[57] ABSTRACT

A container for storing and dispensing semi-soft stick-like food products, such as butter, oleomargarine, and the like can have the elements thereof oriented and re-oriented into positions that are most comfortable to the particular user. The container can be disassembled for easy cleaning.

4 Claims, 1 Drawing Sheet

CONTAINER FOR STORING AND DISPENSING SEMI-SOFT STICKLIKE FOOD PRODUCTS

TECHNICAL FIELD OF THE INVENTION

The present invention relates to the general art of containers, and to the particular field of storing and dispensing containers for use with food products.

BACKGROUND OF THE INVENTION

Basting, roasting and other such cooking procedures often require coating the food product with butter or oleomargarine; likewise, bread, corn on the cob, and the like often are coated with butter or the like before eating.

Accordingly, the container art has many examples of containers for storing and dispensing semi-soft sticklike products, such as butter or oleomargarine. See, for example, the devices disclosed in U.S. Pat. Nos. 2,980,247, 3,162,884 and 3,374,048. All of these devices are intended to make dispensing of such products easy and efficient.

While such devices often work well, they still have deficiencies that inhibit their full commercial acceptance. For example, these devices are often difficult to use and control for a person whose hands are handicapped, as by arthritis or the like. The pressure required to force the butter out of the container may simply be too great for one handed pressure for such a person, and the known dispensers simply are not amenable to efficient and comfortable operation using two hands.

A still further drawback to many such known dispensers is the difficulty associated with the cleaning thereof. It is difficult, especially for one whose hands are not supple, to fully clean such dispensers. Because of the tubular nature of those dispensers, a cleaning device or tool must be inserted into the tubular container and manipulated to effect the full cleaning of the inside surfaces of the container. Insertion and manipulation of such cleaning tools may be difficult for some people whereby all internal surfaces of the container are not fully cleaned in all situations.

Accordingly, there is a need for a container for storing and dispensing semi-soft sticklike food products, such as butter, oleomargarine, or the like, which is easily manipulated and cleaned, as by a person whose hands and fingers may be handicapped.

OBJECTS OF THE INVENTION

It is a main object of the present invention to provide a container for storing and dispensing semi-soft sticklike food products, such as butter, oleomargarine, or the like, which is easily manipulated, as by a person whose hands and fingers may be handicapped.

It is another object of the present invention to provide a container for storing and dispensing semi-soft sticklike food products, such as butter, oleomargarine, or the like, which is easily manipulated and cleaned, as by a person whose hands and fingers may be handicapped.

SUMMARY OF THE INVENTION

These, and other, objects are achieved by a container that can be easily operated and manipulated using two hands and which is easily disassembled for cleaning.

The container has a case on which finger grips are mounted and a plunger mechanism that includes a pusher arm that is rotatably mounted on a pusher plate.

The plunger arm includes a ring thereon which is used to seat the user's finger during a dispensing operation.

By having the pusher arm rotatably mounted on the pusher plate, the finger ring can be moved with respect to the case and the finger grips to place that ring in an orientation that is most easily manipulated by the particular user. In this manner, if the user has an idiosyncrasy, such as arthritic hands or fingers, or the like, the container can be modified to fit their particular needs. In the past, such users were forced to use a container in a manner that may not have been most effective for their particular needs. If their hands were not strong enough to force the plunger against the food product during a dispensing operation using one hand, then the container may not be of much use to them as it could not be easily adapted to two-handed use in a comfortable manner. This may be especially so if the user's hands are handicapped, or are weak, as a child's hands may be weak.

Using the container embodying the present invention, the user can rotate the plunger ring into an orientation that will permit comfortable two-handed operation.

Since the container of the present invention is easily disassembled, there is no need to use special cleaning tools to clean the inner surfaces of the container. All surfaces of the container are easily exposed for thorough cleaning.

DESCRIPTION OF THE DRAWING FIGURES

DETAILED DESCRIPTION OF THE PREFERRED EMBODIMENT OF THE INVENTION

Figure 1:
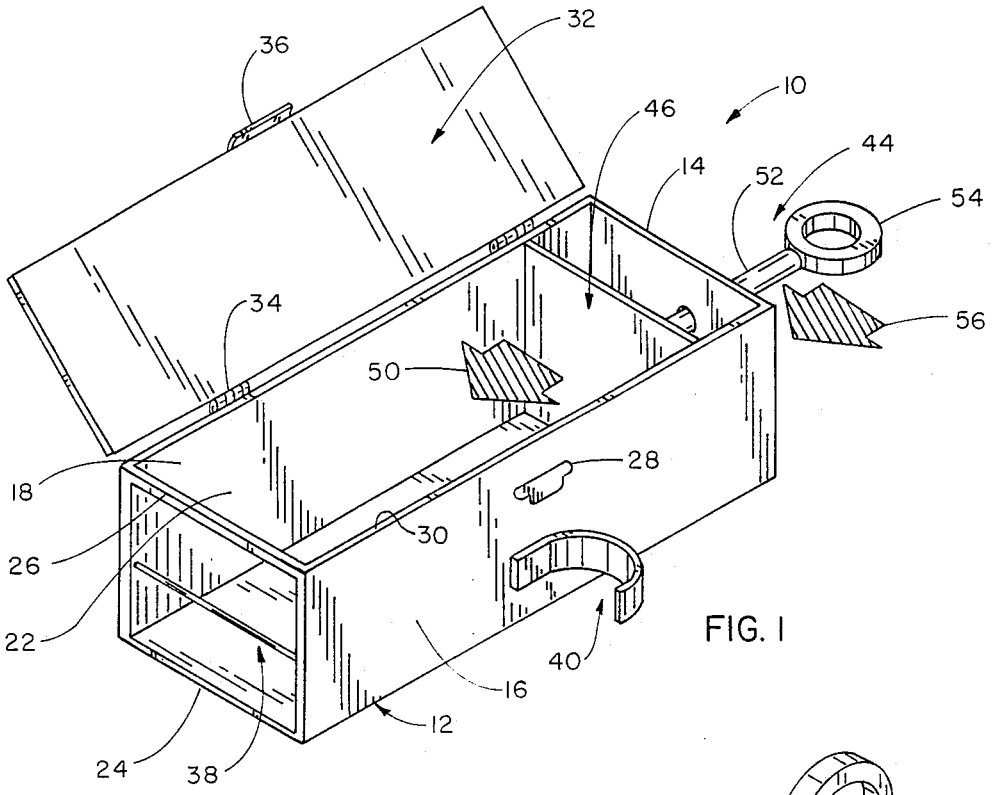
FIG. 1 is a perspective view of the container embodying the present invention.

Shown in FIG. 1 is a container 10 that can be used to store and dispense semi-soft sticklike food products, such as butter, oleomargarine, or the like in a manner that permits the user to orient and manipulate the container in a manner that is most comfortable and efficient for the needs of that particular user.

The container 10 includes a case 12 having an end wall 14 and two side walls 16 and 18. A bottom wall 20 is connected to the end wall and to the side walls to form a container case that has an open top 22 and an open end 24. The open end includes a crossbeam 26 extending between the two side walls, and a latch-receiving recess 28 is defined in the side wall 16 near top edge 30 of that wall. The walls and the crossbeam 26 all have top edges, such as top edge 30, that are located in a common plane to define an access opening via the open top 22.

A door 32 is pivotally mounted on the side wall 18 to cover the access opening, and hinges, such as hinge 34, are used to permit the door 32 to open and close. A latch 36 is mounted on the door to be received in the recess 28 to releasably lock the door to the side walls of the case.

A wire 38 is attached at its ends to the walls 16 and 18 and extends across the open end of the container. The wire is a support, and serves to keep the food product in place during storage.

The container 10 also includes two U-shaped finger grips, such as finger grip 40. The two finger grips are identical and each includes a body that is concave with respect to the open end of the container so that the user's finger can be placed on the concave surface to hold the container as will be apparent from the ensuing discussion. The finger grips are mounted on the walls to extend outward from such walls as indicated in FIG. 1 to be accessible for easy gripping.

The container 10 furthter includes a plunger mechanism 44 that is used to force the food product out of the case 12. The plunger mechanism 44 includes a pusher plate 46 that is slidably received in the case to move in a direction indicated by arrow 50 toward the open end of the case to force the food product out of that case. The pusher plate can be removed from the case via the open top of the case for cleaning, replacement or the like.

The plunger mechanism further includes a pusher arm 52 that is mounted at one end thereof on the pusher plate and which extends through the end wall 14. The arm 52 has a ring 54 on another end thereof. The ring is sized and configured to receive the user's finger to control operation of the pusher plate via the pusher arm. Forcing the pusher arm in the direction indicated by arrow 56, forces the pusher plate in the direction 50 to dispense food product from the case via the open end of that case.

Figure 2:
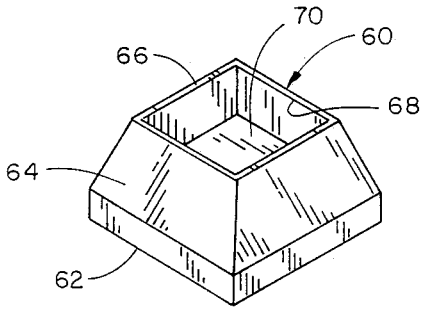
FIG. 2 is a perspective view of a base used to support the FIG. 1 container is an upright orientation.

The container 10 further includes a supporting stand 60, best shown in FIG. 2. The stand 60 supports the case in an upright orientation and fits over the open end of the case to close that case during storage. The stand includes a base 62 that is wide enough to securely support the case in an upright orientation, and walls, such as wall 64, that extend upward from the base and which converge toward each other to form a turncated figure as shown in FIG. 2. Each of the walls has an upper edge, such as edge 66, and all of the upper edges are in a common plane and a case entrance opening 68 is defined in such common plane by such upper edges.

The stand 60 also includes a platform 70 that is attached to the inner surfaces of the walls 64 and is spaced from the entrance opening 68. The platform and the inner surfaces of the walls 64 define a case-receiving chamber. When the case is supported on the stand 60, the rims of the walls 16, 18 and 24, as well as the crossbeam 26 are all supported on the platform, and the walls of the case snugly abutt the inner surfaces of the stand walls.

Figure 3:
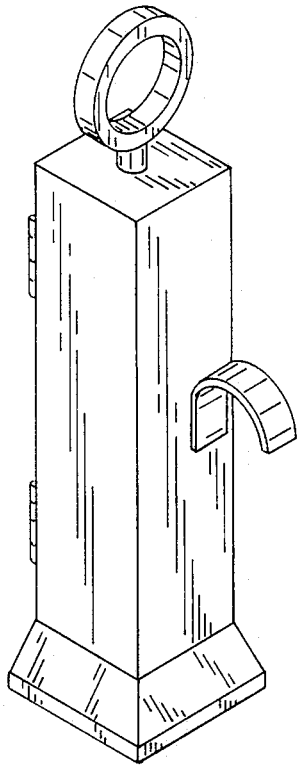
FIG. 3 is a perspective view of the container of the present invention showing the ring thereof rotated 90° from the FIG. 1 orientation.

The upright orientation of the case supported in the stand is best shown in FIG. 3. The container 10 is used by removing the case from the stand, placing the user's fingers on the finger grips 40, placing the user's thumb in the ring 54 and forcing the plunger in direction 56. The wire 38 keeps the food product from moving out of the case in an undesirable manner either during storage or during dispensing.

The food product can be removed or replenished via the open top of the case, and the case is easily disassembled for cleaning.

As was discussed above, there may be situations in which a user cannot efficiently operate the plunger mechanism 44 with one hand. In such an instance, the user is able to manipulate the container 10 using two hands without sacrificing comfort or efficiency. This feature of the container is achieved by providing the plunger mechanism with means for permitting the ring to be re-oriented from one position to another as is indicated by comparing the orientation of the ring in FIG. 1 to the orientation of the ring in FIG. 3. By permitting such re-orientation of the ring, the user can support the case in one hand and manipulate the ring with the other hand while holding the case in a position and orientation that is most comfortable to that particular user for such two-handed operation. It is noted that the ring in FIG. 3 is oriented 90° from the orientation shown in FIG. 1; however, the ring can assume any orientation without departing from the scope of this disclosure, and the 90° rotation is presented merely for the purposes of illustration and no limitation is intended.

Figure 4:
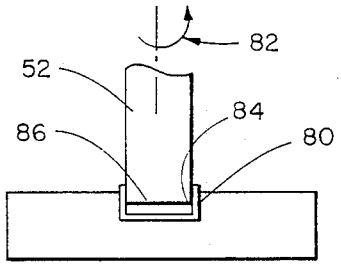
FIG. 4 is a cross-sectional elevational view of the pusher plate of the container of the present invention.

The rotatable feature of the plunger mechanism is achieved by mounting the pusher arm on the pusher plate using a step bearing 80 as shown in FIG. 4. Rotation of the plunger arm is indicated in FIG. 4 by arrow 82. The bearing holds the arm snugly enough so that such arm will not fall out of the container, and can indicate a projection 84 that circumnavigates the step bearing and is received in a groove 86 defined in the arm 52 in a snap fit type connection. The pusher arm and bearing are preferably plastics-type material so that the projection and the arm adjacent to the groove can flex to permit the projection to snap into and out of the groove.

The container and its component parts can be manufactured of any material suitable for use in containing, storing and dispensing food products, such as butter or the like, and which can be easily cleaned. Plastics-type materials are suitable and preferred.

It is understood that while certain forms of the present invention have been illustrated and described herein, it is not to be limited to the specific forms or arrangements of parts described and shown.

I claim:

1. A container for storing and dispensing semi-soft sticklike food products, such as butter, oleomargarine, or the like, comprising:

(A) a case having
  (1) an end wall,
  (2) two side walls connected to said end wall,
  (3) a bottom wall connected to said end and side walls,
  (4) an open top,
  (5) a latch-receiving recess defined in one of said two side walls, and
  (6) an open end;

(B) a door pivotally mounted on a second one of said side walls by a hinge means and including a latch;

(C) a wire mounted on said side walls and extending across said open end;

(D) a U-shaped finger grip mounted on each side wall and being concave with respect to said open end;

(E) a plunger mechanism which includes
  (1) a pusher plate slidably mounted inside said case to move from said end wall toward said open end,
  (2) a pusher arm rotatably mounted at one end thereof to said pusher plate and extending through said end wall, and
  (3) a ring mounted on another end of said pusher arm; and (F) a stand which includes
  (1) a base,
  (2) stand walls attached to said base and extending away from said base to converge towards each other, each end wall having an upper edge, (3) an upper rim defined by said wall upper edges, and
(4) a support platform connected to said stand walls at a location spaced from said rim to define with said stand walls a case-receiving chamber.

2. The container defined in claim 1 further including a step hearing on said pusher plate and receiving said pusher arm one end.

3. The container defined in claim 2 further including a snap fit means connecting said pusher arm to said step bearing.

4. The container defined in claim 3 wherein said snap fit means includes a groove defined in said pusher arm and a projection on said step bearing.

* * * * *